US007215291B2

(12) United States Patent
Nakano et al.

(10) Patent No.: US 7,215,291 B2
(45) Date of Patent: May 8, 2007

(54) ANTENNA DEVICE

(75) Inventors: Kazuya Nakano, Tokyo (JP); Hiroyuki Maeda, Novi, MI (US); Katsushiro Ishibayashi, Novi, MI (US); Satoshi Nagasawa, Farmington Hills, MI (US); Hajime Saito, Hino (JP); Kazuhiko Furukatsu, Hachioji (JP); Kentaro Toda, Hino (JP)

(73) Assignees: Harada Industry Co., Ltd, Tokyo (JP); Japan Aviation Electronics Industry Limited, Tokyo (JP)

( * ) Notice: Subject to any disclaimer, the term of this patent is extended or adjusted under 35 U.S.C. 154(b) by 64 days.

(21) Appl. No.: 11/246,785

(22) Filed: Oct. 11, 2005

(65) Prior Publication Data

US 2006/0077112 A1 Apr. 13, 2006

(30) Foreign Application Priority Data

Oct. 12, 2004 (JP) ..... 2004-298027

(51) Int. Cl.
*H01Q 1/32* (2006.01)

(52) U.S. Cl. ..... 343/715; 343/713; 343/906; 343/711; 343/882

(58) Field of Classification Search ..... 343/713, 343/715, 711, 882, 719, 878; 403/197, 252
See application file for complete search history.

(56) References Cited

U.S. PATENT DOCUMENTS 7,004,666 B2 * 2/2006 Kozlovski ..... 403/252
7,088,297 B2 * 8/2006 Nakano et al. ..... 343/713
2003/0068198 A1 4/2003 Kozlovski

FOREIGN PATENT DOCUMENTS

| | | |
|---|---|---|
| DE | 198 02 265 A1 | 8/1999 |
| EP | 0 632 520 A1 | 1/1995 |
| EP | 0 720 250 A1 | 7/1996 |
| FR | 2 563 946 | 11/1985 |
| JP | 2001-36315 | 2/2001 |
| JP | 2004-48599 | 2/2004 |
| WO | WO 00/35045 | 6/2000 |

* cited by examiner

*Primary Examiner*—Tho Phan
*Assistant Examiner*—Chuc Tran
(74) *Attorney, Agent, or Firm*—Nixon & Vanderhye P.C.

(57) ABSTRACT

An antenna main body comprises an antenna element, female connectors provided at a first connector, a female screw section, and an engagement claw inserted into an antenna mount hole H to make engagement with a lower side face of a roof panel R. A fixing member comprises cables, male connectors provided at a second connector, the male connectors being provided to make mechanical engagement with, and electrical connection to, female connectors, and being connected to the cable, and a male screw section helically fitted to a female screw section, thereby tightening the female connectors, the male connectors, and a roof panel R with one another.

7 Claims, 9 Drawing Sheets

ANTENNA DEVICE

CROSS-REFERENCE TO RELATED APPLICATIONS

This application is based upon and claims the benefit of priority from prior Japanese Patent Application No. 2004-298027, filed Oct. 12, 2004, the entire contents of which are incorporated herein by reference.

BACKGROUND OF THE INVENTION

1. Field of the Invention

The present invention relates to an antenna device mounted on a vehicle body such as an automobile, and more particularly, to an antenna device capable of simplifying a mounting work and reliably making connection even in the case of a composite antenna capable of receiving a plurality of frequency bandwidths.

2. Description of the Related Art

Conventionally, it has been well known that a variety of antenna devices are mounted on a vehicle body of an automobile (for example, Jpn. Pat. Appln. KOKAI Publication Nos. 2001-36315 and 2004-48599). FIGS. 14 and 15 are views each showing an example of such an antenna device. That is, an antenna device 1 is composed of: an antenna main body 2 provided at an upper side of a roof panel R; and a mount nut 10 provided at a lower side of the roof panel R. The antenna main body 2 comprises: an antenna cover 3; an antenna element 4 mounted on the antenna cover 3; a pad section 5 disposed between the antenna cover 3 and the roof panel R; and a base section (not shown) and a substrate 6 provided at the pad section 5. A matching circuit or an amplifier circuit and a duplexer are incorporated in the substrate 6.

A protrusion section 7 is provided on a lower face of the base section as shown in FIG. 15, and is inserted into an antenna mount hole. A through hole is formed at the inside of the protrusion section 7, and an AM/FM coaxial cable 8 for transmitting a signal and a power supply line 9 for supplying power to the substrate 6 are drawn via the through hole.

The mount nut 10 comprises a ground washer 11 and a nut section 12, and the ground washer 11 is assembled to be rotatable with respect to the nut section 12.

In such an antenna device 1, the antenna main body 2 is first mounted on the antenna mount hole of the roof panel R from overhead shown in FIG. 15. At this time, the antenna main body 2 is temporarily locked so as to be immobilized by a temporarily locking claw 7*b* or the like. Next, the coaxial cable 8 and the power supply line 9 are routed into a through hole of the protrusion section 7 of the pad section 5. Then, the nut section 12 of the mount nut 10 is helically fitted to the screw section 7*a* formed on an outer periphery face of the protrusion section 7. Further, when the nut section 12 is rotated, a triangle shaped distal end of the ground washer 11 is cut into a lower face side of the roof panel R shown in FIG. 15, and the antenna main body 2 is securely fixed to the roof panel R and is grounded.

The above-described antenna device has suffered from the following problem. That is, in recent year, an antenna device has often been configured as a composite antenna having incorporated therein a high frequency patch antenna such as GPS, mobile broadcast, ETC, or SDARS in addition to an AM/FM broadcast receiving antenna. Further, there may be a need for a power supply cable for use in an amplifier incorporated in the antenna main body. Therefore, the number of cables or the like must be routed into the antenna mount holes, resulting in complicated work.

In addition, there has been a need for a work of connecting their respective cables to vehicle side cables inside of the vehicle body, and there has been an increased worker's burden. Further, in the case of a connector for use in connecting a high frequency bandwidth cable, a range of an error allowable at the time of connection is very narrow, and thus, there has been a problem that skillfulness is required for a connection work.

Further, there has been a problem that work efficiency becomes low since the antenna main body is temporarily stopped in an unstable manner when the main body is positioned on the roof panel. Furthermore, since a worker must do a work with one's face being upwardly oriented, there has been a possibility that the ground washer or nut may be accidentally dropped.

BRIEF SUMMARY OF THE INVENTION

It is an object of the present invention to provide an antenna device capable of assembling an antenna main body in accordance with simplified procedures and capable of reliably connecting an antenna element and a cable to each other and reliably providing grounding.

The antenna device according to the invention is composed as follows. In the antenna device mounted on a mount hole provided in a plate material, there are provided: an antenna main body disposed on one face side of the plate material; and a fixing member disposed on the other face side of the plate material, the fixing member fixing the antenna main body to the plate material. The antenna main body comprises: an antenna element; a first connector electrically connected to the antenna element; a first screw section provided in a tightening direction in which an axial center line passes through the mount hole; and an engagement section inserted into the mount hole from the one side face, thereby achieving engagement on the other face side. The fixing member comprises a feeder line provided to make connection with the antenna element; a second connector provided to make mechanical engagement and electrical connection with the first connector; and a second screw section helically fitted to the first screw section, thereby tightening the antenna main body, the above fixing member, and the plate material with one another.

According to the invention, the antenna device can be assembled in accordance with simplified procedures, and makes it possible to reliably connecting the antenna element and cables to each other and reliably providing grounding.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate embodiments of the invention, and together with the general description given above and the detailed description of the embodiments given below, serve to explain the principles of the invention.

DETAILED DESCRIPTION OF THE INVENTION

Figure 1:
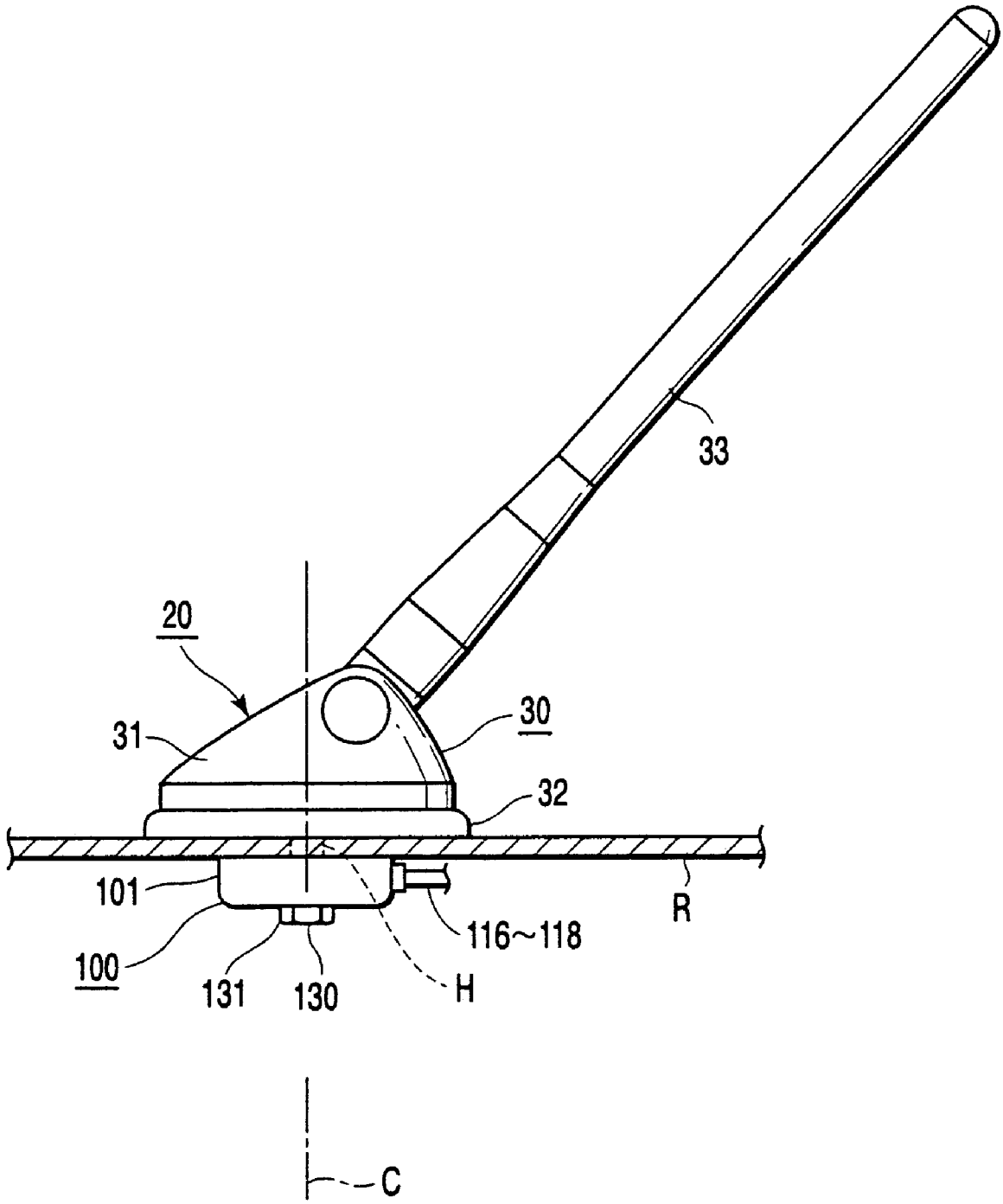
FIG. 1 is a side view showing an antenna device according to a first embodiment of the present invention.
Figure 2:
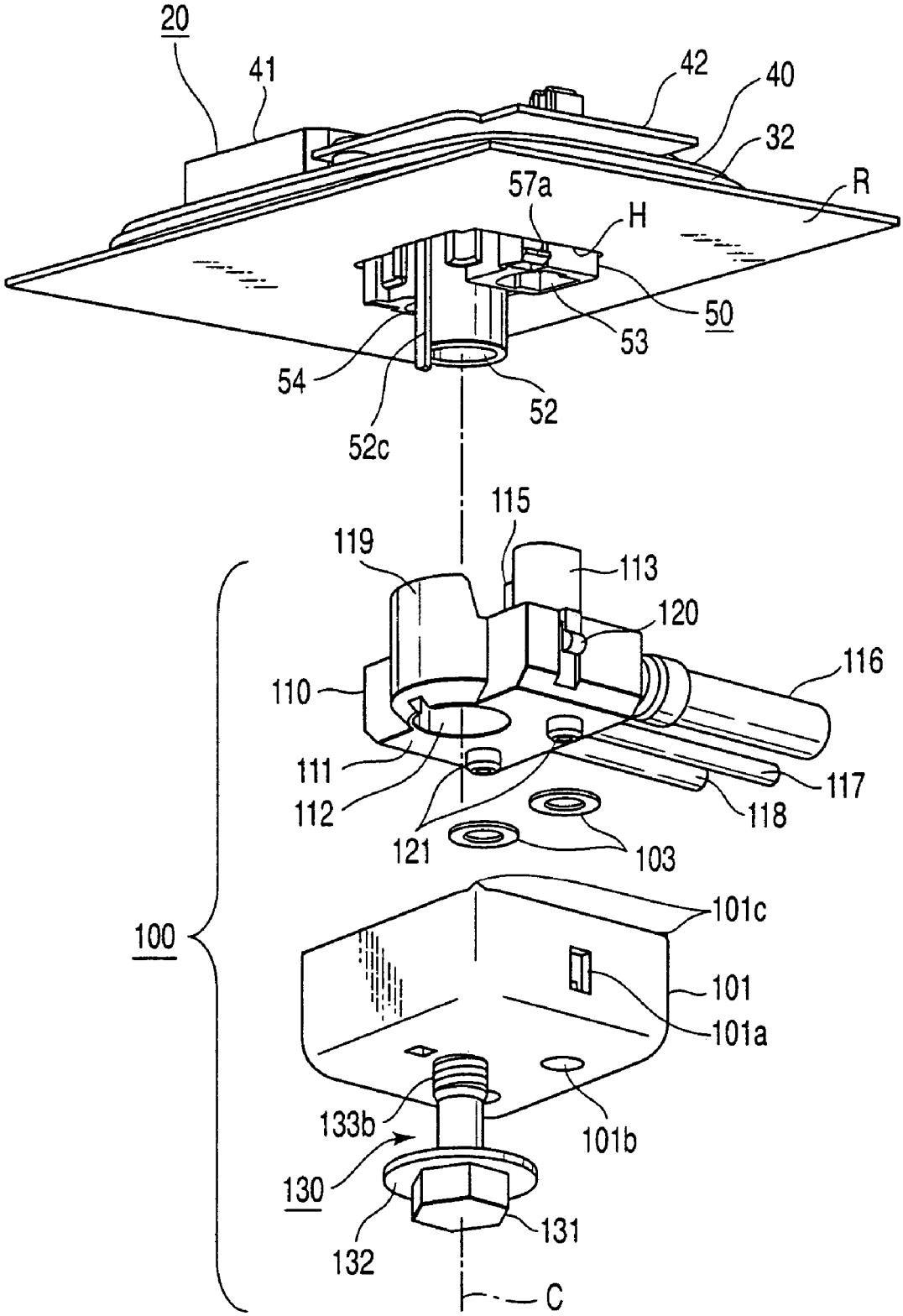
FIG. 2 is an exploded perspective view showing the antenna device from the lower side.
Figure 3:
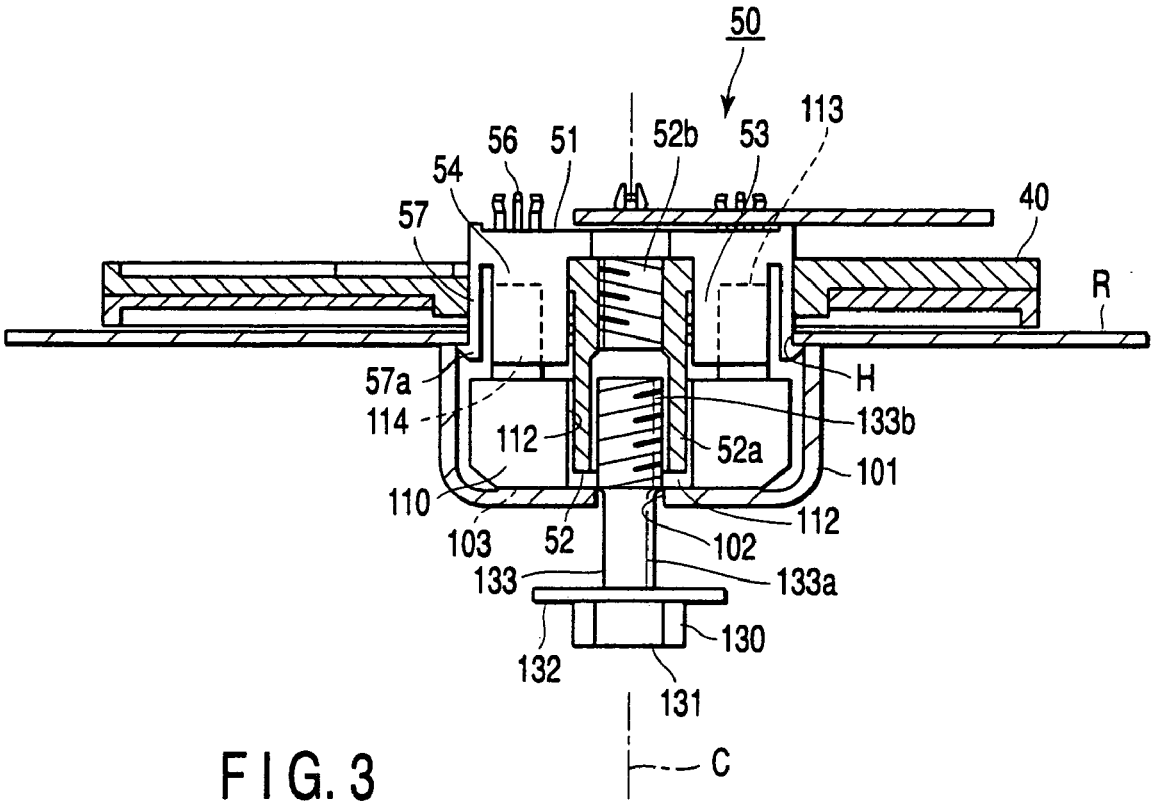
FIG. 3 is a longitudinal cross section showing the antenna device.
Figure 4:
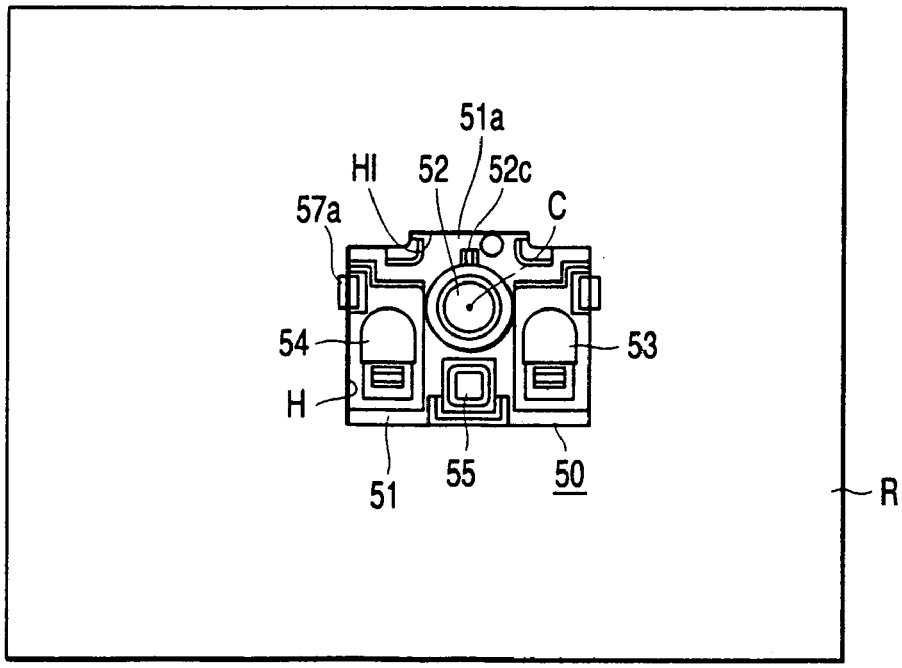
FIG. 4 is a plan view showing an antenna main body of the embodiment from a lower side when the main body is inserted into a roof panel.
Figure 5:
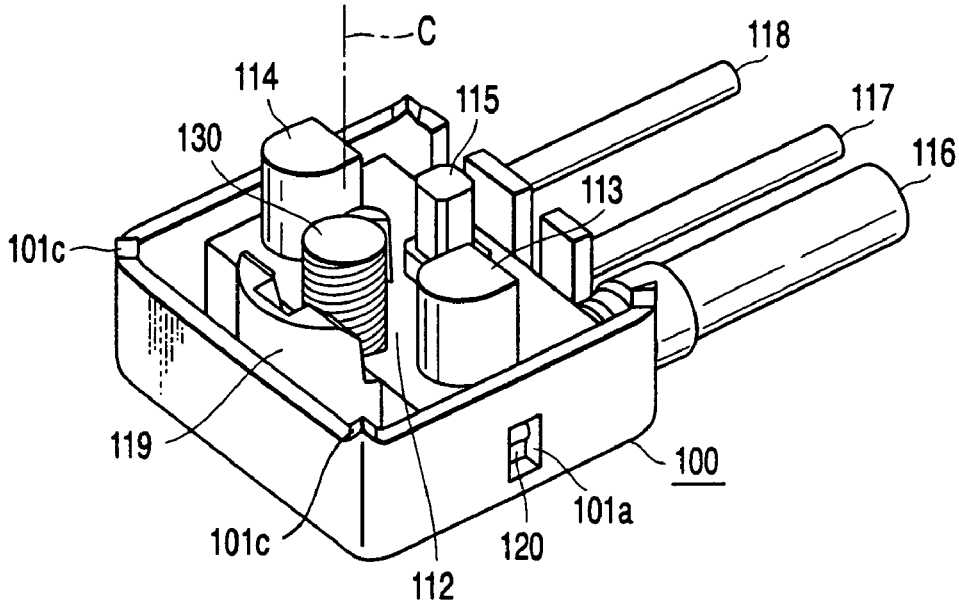
FIG. 5 is a perspective view showing a fixing member of the embodiment.
Figure 6:
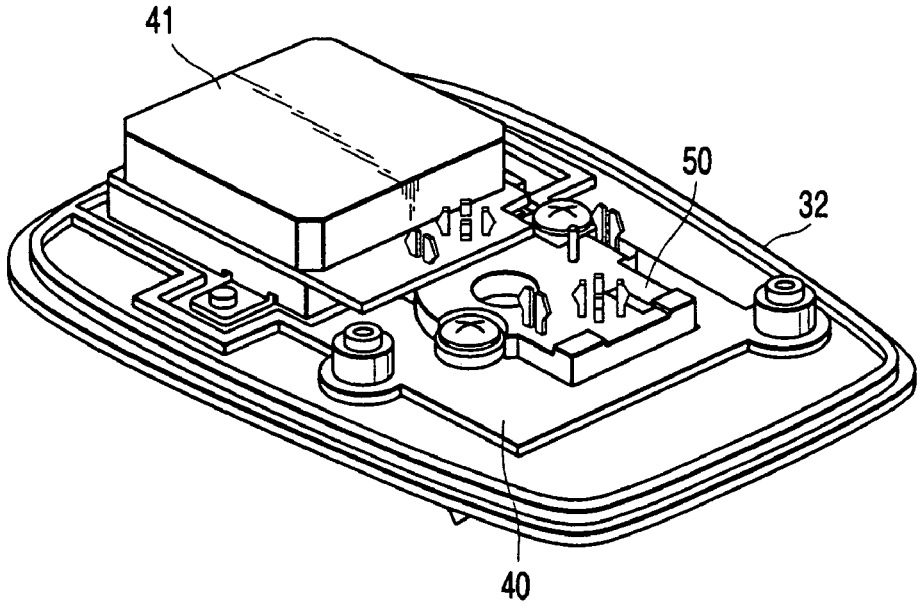
FIG. 6 is a perspective view showing a process of assembling the antenna main body.
Figure 7:
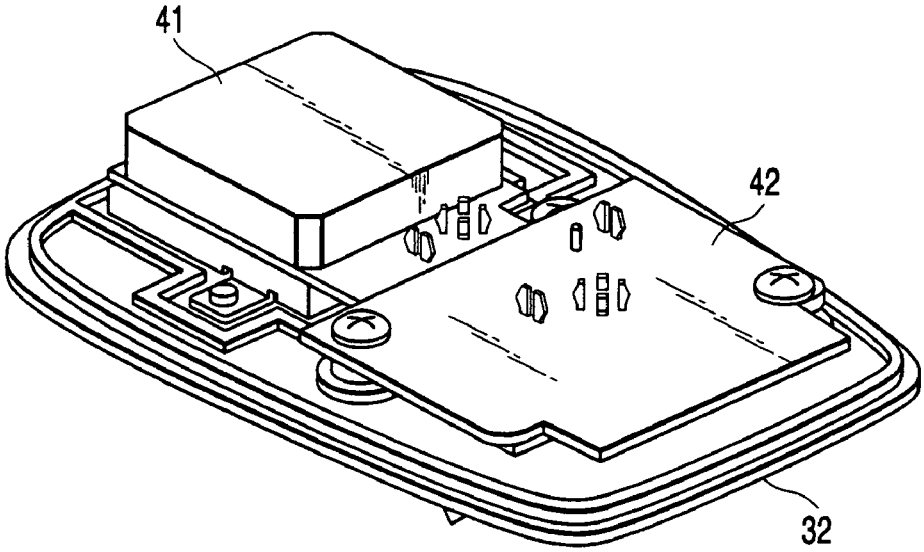
FIG. 7 is a perspective view showing a process of assembling the antenna main body.
Figure 8:
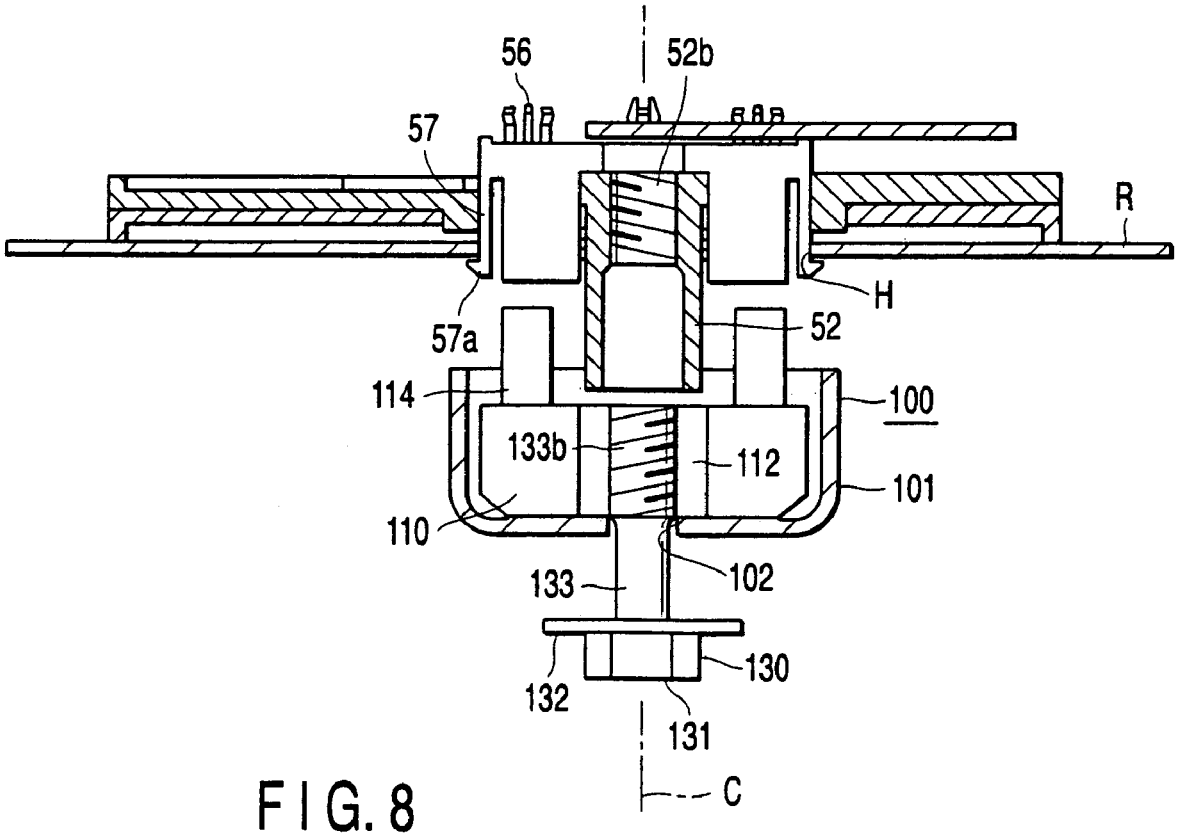
FIG. 8 is a longitudinal section view showing a process of assembling the antenna device.
Figure 9:
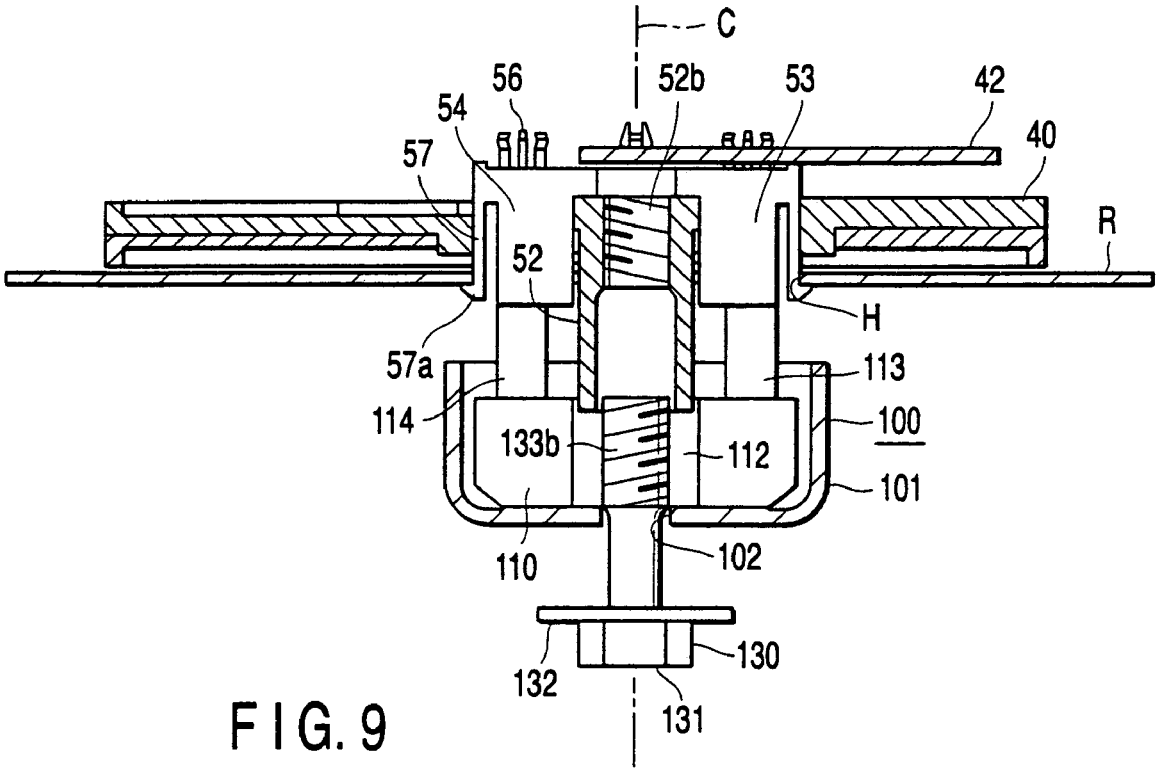
FIG. 9 is a longitudinal section view showing a process of assembling the antenna device.
Figure 10:
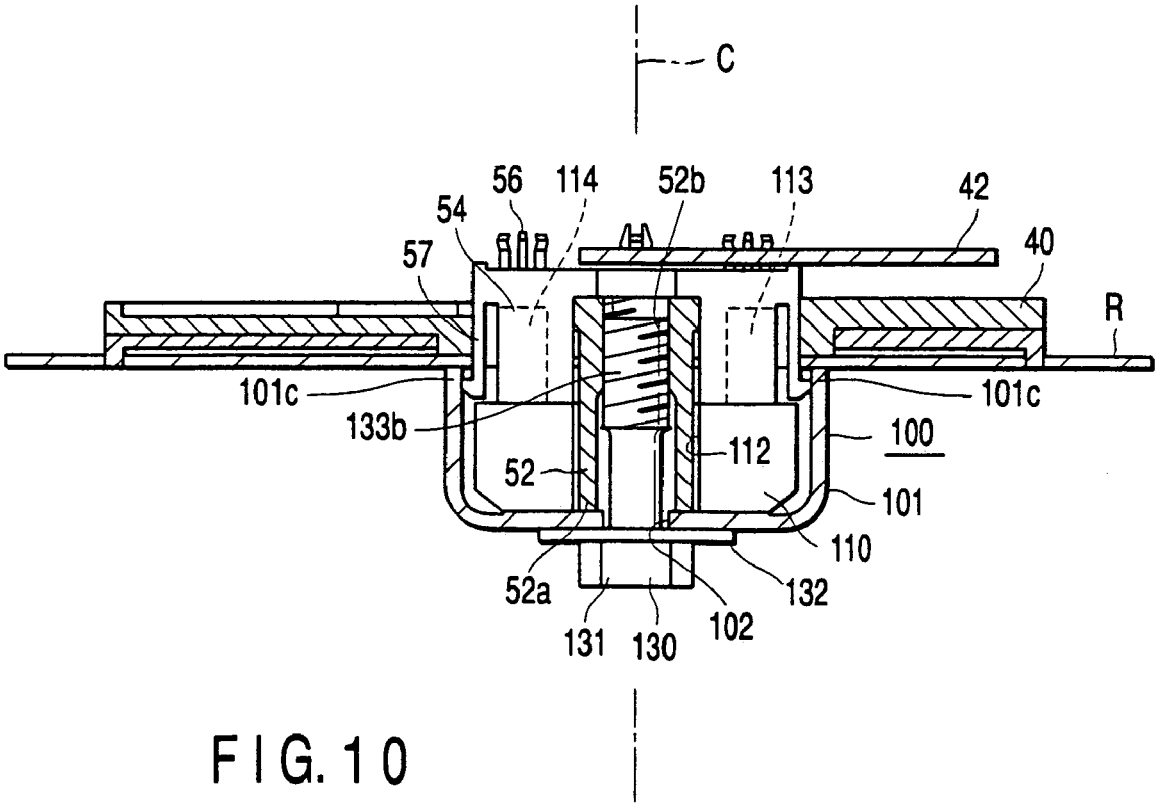
FIG. 10 is a longitudinal section view showing a process of assembling the antenna device.

FIG. 1 is a side view showing an antenna device 20 according to a first embodiment of the present invention; FIG. 2 is an exploded perspective view showing the antenna device 20 from the lower side; FIG. 3 is a longitudinal cross section showing the antenna device 20; FIG. 4 is a plan view showing an antenna main body 30 from a lower side when the main body is inserted into a roof panel R; FIG. 5 is a perspective view showing a fixing member 100; FIGS. 6 and 7 are perspective views showing a process of assembling the antenna main body 30; and FIGS. 8 to 10 are longitudinal section views showing a process of assembling the antenna device 20. C in these figures indicates a tightening direction in which a screw is mounted by tightening a bolt 130 described later. In addition, R in these figures indicates a roof panel which configures a vehicle body such as an automobile, and H indicates an antenna mount hole. The antenna mount hole H is formed in a substantially rectangular shape, and a cutout H1 is partly formed.

The antenna device 20 comprises the antenna main body 30 and the fixing member 100 as shown in FIG. 1. The antenna main body 30 comprises an antenna cover 31 and a pad 32 pinched between the antenna cover 31 and the roof panel R. An AM/FM antenna element 33 is mounted on the antenna cover 31.

A base 40 is mounted on the pad 32 as shown in FIG. 6. A patch antenna 41, a substrate 42, and a first connector 50 are mounted on the base 40.

The first connector 50, as shown in FIG. 3, comprises: a rectangular plate shaped connector main body 51; a cylinder body 52 provided at a center part of a lower face side of the connector main body 51 shown in FIG. 3; three female connectors 53 to 55 disposed at the periphery of the cylinder body 52 in parallel to an axial direction of the cylinder body 52; a terminal 56 provided at an upper face side of the connector main body 51 shown in FIG. 3, and connected to the female connectors 53 to 55; and a spring plate 57 erected from a side face of the connector main body 51. A protrusion section 51*a* matching the cutout H1 is formed on the side face of the connector main body 51.

The cylinder body 2 has two types of internal diameters, and comprises an inner cylinder section 52*a* having a slightly larger diameter and a female screw section 52*b* having a slightly small diameter in which a female screw has been formed on its inner face. On an outer periphery face of the cylinder body 52, a protrusion stripe section 52*c* is formed along an axial direction of the cylinder body 52.

The spring plate 57 is formed so as to be slackened in a transverse direction shown in FIG. 3 while the engagement claw 57*a* is formed at a distal end of the sprint plate. The engagement claw 57*a* is formed so as to engage with a peripheral edge at the vehicle inside (lower face in FIG. 3) of the antenna mount hole H of the roof panel R.

The fixing member 100, as shown in FIG. 2, comprises: a bottomed cylinder shaped cover body (grounding member) 101 made of an electrically conductive material, for example, stainless or nickel plated iron; a second connector 110; and a bolt 130. In addition, a through hole 102 is formed at the cover body 101, the through hole having formed therein a female screw helically fitted by a male screw section 133*b* of the bolt 130 described later. In addition, a wave washer (elastic body) 103 is disposed in a gap between the cover body 101 and the second connector 110 and biases the second connector 110 upwardly.

An engagement hole 101*a*, a positioning hole 101*b*, and a protrusion section 101*c* are formed on the cover body 101. The engagement hole 101*a* restricts a movement other than a tightening direction of an engagement claw 120 described later by engaging it with the engagement claw 120. The positioning hole 101*b* positions the cover body 101 and the second connector 110 due to a protrusion section 121 described later being inserted thereinto. The protrusion section 101*c* abuts against the roof panel R.

The engagement claw 120 is configured to engage the cover body 101 and the second connector 110 with each other and to prevent the second connector 110 from being connected to the first connector 50 by a predetermined force or more at the time of bolt tightening. Therefore, a length in the tightening direction of the engagement hole 101*a* is defined such that the second connector 110 is connected to the first connector 50 at a desired position based on a relationship with a biasing force of the wave washer 103 at the time of tightening of the bolt 130.

The second connector 110, as shown in FIG. 3, comprises: a rectangular prism shaped connector main body 111; a through hole 112 provided at a center part of the connector main body 111, the above-described cylinder body 52 being inserted into the through hole; male connectors 113 to 115 disposed at the periphery of the through hole 112, and provided to be connected to the above-described female connectors 113 to 115; a guide section 119 provided in parallel to the through hole 112; and an engagement claw 120 provided on a side face of the connector main body 111. In addition, reference numeral 121 shown in FIG. 2 denotes a protrusion section which restricts movement of the wave washer 103.

The cylinder body 52 is provided so as to be freely inserted by the through hole 112 and the guide section 119 and is formed such that rotation in an axial direction of the cylinder body 52 is restricted by a protrusion stripe section 52*c*.

The bolt 130 comprises: a nut 131; a washer 132 integrated with the nut 131; and a shaft body 133. The shaft body 133 comprises: a shaft body section 133*a* having a slightly smaller diameter provided at the side of the nut 131; and a male screw section 133*b* having a slightly larger diameter provided at a distal end side. The male screw section 133*b* is provided so as to be helically fitted to the female screw 52*b* of the cylinder body 52.

The thus configured antenna device 20 is assembled as follows. The antenna main boy 30 and the fixing member 100 are assembled in advance. The antenna main body 30 mounts the patch antenna 41 for high frequency bandwidth on the first connector 50 as shown in FIG. 6. Further, as shown in FIG. 7, the substrate 42 is mounted. From a terminal of the substrate 42, connection to an antenna element 33 is made via a lead wire (not shown), and the antenna cover 31 is mounted. In addition, the fixing member 100 inserts the bolt 130 in advance into the through hole 102 of the cover body 101 as shown in FIG. 8. At this time, a female screw is formed in the through hole 102. Thus, the male screw section 133*b* of the bolt 130 is threaded, thereby preventing the bolt 130 from slipping off from the cover body 101.

The subsequent assembling process is roughly divided into three steps. That is, a first step is a step of temporarily locking the antenna main body 30; a second step is a step of temporarily locking the fixing member 100; and a third step is a step of tightening the bolt 130. Now, each of these steps will be described below.

In the first step, first, the pad 32 is positioned at the periphery of the antenna mount hole H on the roof panel R and the first connector 50 is inserted into the antenna mount hole H. At this time, the spring plate 57 is bent inwardly by an edge part of the antenna mount hole H before passing through the antenna mount hole H, and then, passes through the mount hole H. Then, the spring plate returns to its original shape and protrudes from the antenna mount hole H, so that the engagement claw 57*a* engages with a back face of the roof panel R and the first connector 50 is temporarily locked with the roof panel R. This state is shown in FIGS. 2 and 3.

When the first connector 50 is inserted into the antenna mount hole H, the connector is mounted such that the protrusion section 51*a* coincides with the cutout H1 in order to prevent incorrect orientation.

In the second step, as shown in FIG. 9, the male connectors 113 to 115 of the second connector 110 are inserted into the female connectors 53 to 55. Mechanical engagement and temporary tightening are achieved at a time point when the male connectors 113 to 115 have been inserted to a predetermined depth of the female connectors 53 to 55. At this time, electrical conduction is also achieved.

In the third step, as shown in FIG. 10, the male section 133*b* reaches the female screw section 52*b* of the cylinder body 52 when the bolt 130 is screwed. Then, the male section is helically fitted and tightened. The tightening of the bolt 130 is stopped at a time point when the washer 132 is compressed against the cover body 101 by a proper force. The protrusion section 101*c* of the cover body 101 cuts into the roof panel R, whereby grounding is provided.

According to the thus configured antenna device 20, a first temporary lock is carried out by inserting the first connector 50 into the antenna mount hole H (first step); a second temporary lock is carried out by inserting the second connector 110 into the first connector 50; and lastly, fixing and grounding are carried out by tightening the bolt 130 (step 3). Accordingly, the antenna device 20 can be mounted on the antenna mount hole H of the roof panel R with a simplified work, and it becomes possible to reliably provide connection and grounding.

In addition, the second connector 110 can make connection between the male connectors 113 to 115 and the female connectors 53 to 55 each with respect to the cover body 101 in a predetermined design scope by means of working the engagement claw 120 and the engagement hole 101*a*.

Since the second connector 110 has a floating structure along the tightening direction C with respect to the cover body 101, and the wave washer 103 is arranged between the connector and the cover body 101, the second connector 110 is biased to the side of the first connector 50 by the cover body 101 with a proper force. Therefore, the male connectors 113 and the female connectors 53 to 55 are always connected to each other in a proper range, so that a contact state is properly maintained. That is, in a signal having a high frequency bandwidth, there is a case where the signal is not properly transmitted due to a slight shift in the contact state. However, the male connectors 113 to 115 are engaged with the female connectors 53 to 55 with a proper force, as described above, thus making it possible to prevent a loss in connection portion.

As described above, according to the antenna device 20 of the first embodiment, the antenna main body 30 can be assembled in accordance with the simplified procedures. Moreover, the antenna element 33, the pad antenna 41, and the cables 116 to 118 are reliably connected to one another, making it possible to reliably provide grounding.

The biasing means may be made of another material instead of elastic material. For example, it may be a small strip that projects slantwise to a position where the first connector 50 contacts the second connector 110. The strip can work as a blade spring.

By eliminating the wave washer 103 (elastic body), a similar function, i.e., a function of setting the second connector 110 to be connected to the first connector 50 at a desired position may be provided at the side of the first connector 50.

Figure 11:
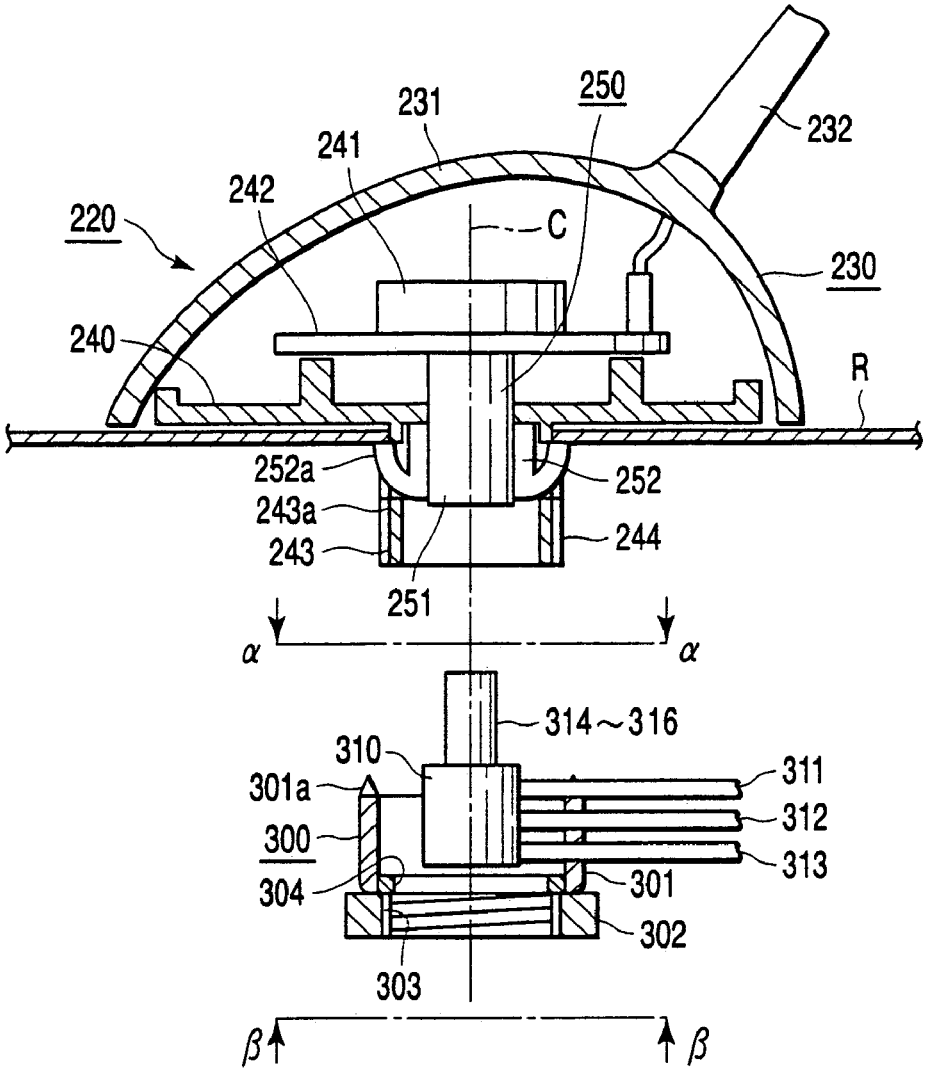
FIG. 11 is a longitudinal cross section showing an antenna device according to a second embodiment of the present invention in an exploded manner.
Figure 12:
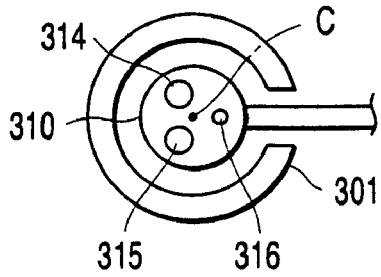
FIG. 12 is a plan view when the antenna device is seen in the direction indicated by the arrow in double dot and chain line α shown in FIG. 11.
Figure 13:
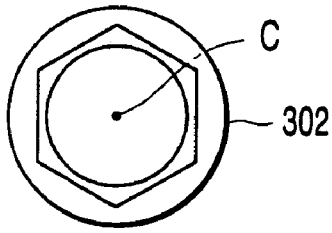
FIG. 13 is a plan view when the antenna device is seen in the direction indicated by the arrow in double dot and chain line β shown in FIG. 11.
Figure 14:
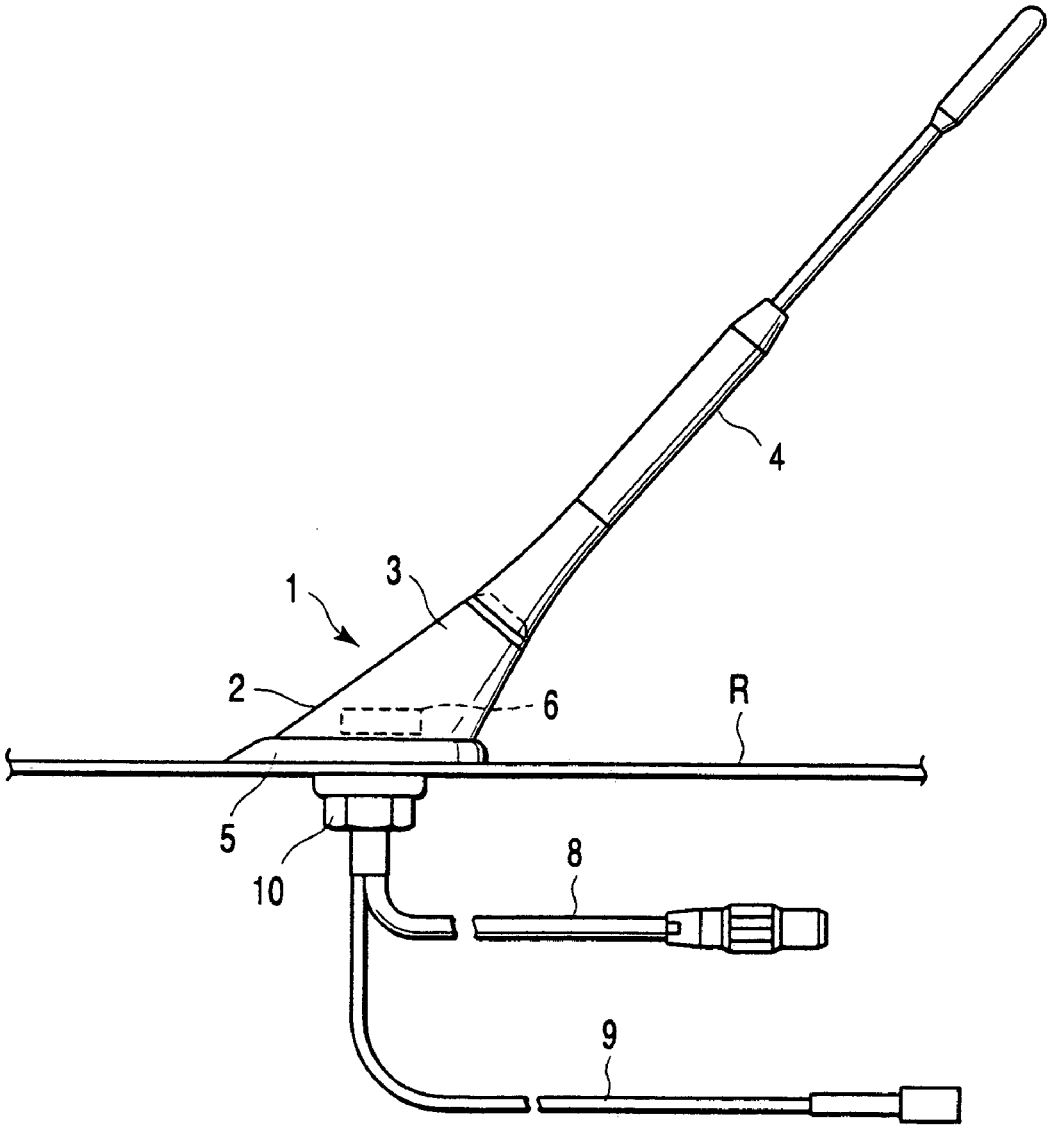
FIG. 14 PRIOR ART
FIG. 14 is a side view showing a conventional antenna device for use in an automobile.
Figure 15:
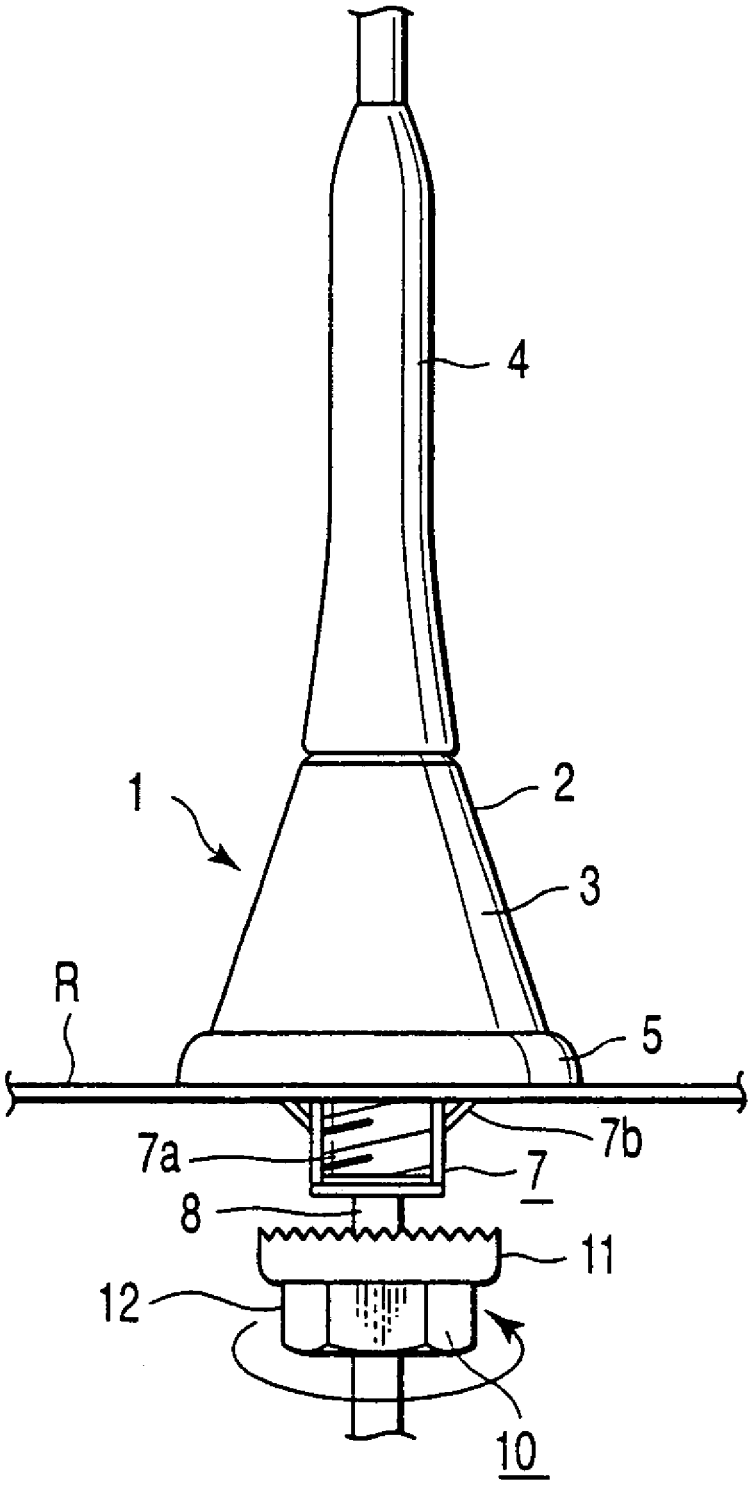
F I G. 1 5 PRIOR ART
FIG. 15 is an enlarged side view showing essential portions of the antenna device for use in an automobile.

FIG. 11 is a longitudinal cross section showing an antenna device 220 according to a second embodiment of the present invention in an exploded manner; FIG. 12 is a plan view when the antenna device is seen in the direction indicated by the arrow in double dot and chain line α shown in FIG. 11; and FIG. 13 is a plan view when the antenna device is seen in the direction indicated by the arrow in double dot and chain line β shown in FIG. 11. C in these figures indicates a tightening direction in which a screw is mounted by tightening a nut 302 described later.

The antenna device 220 comprises an antenna main body 230 and a fixing member 300. The antenna main body 230 comprises an antenna cover 231 and an AM/FM antenna element 232 mounted on the antenna cover 231.

A base 240 is mounted at the inside of the antenna cover 231 as shown in FIG. 11. A patch antenna 241 and a substrate 242 are provided at an upper face side of the base 240. In addition, a cylinder body 243 is provided at a lower face side of the case 240, and a male screw 244 is formed on its outer periphery face. A cutout 243*a* is formed on the cylinder body 243. Further, a first connector 250 is mounted on a lower face side of the substrate 242.

The first connector 250 comprises a cylinder shaped connector main body 251, and a temporary lock collar 252 engaged with an outer periphery wall of the connector main body 251. The temporary lock collar 252 comprises an engagement claw 252*a* protruding to the outside from the cutout 243*a* provided at the cylinder body 243. Three female connectors 253 to 255 are formed at the inside of the connector main body 251. An engagement claw 252*a* is formed so as to slacken in a vertical direction shown in FIG. 11, and is formed such that its distal end engages with a peripheral edge of the vehicle inside (lower face in FIG. 11) of the antenna mount hole H of the roof panel R.

The fixing member 300 comprises a cylinder shaped cover body (ground member) 301, a nut 302 mounted to be rotatable with respect to the cover body 301, and a second connector 310 provided in the cover body 301. Cables 311 to 313 are connected to the second connector 310, and these cables each are connected to the male connectors 314 to 316, respectively. In addition, these male connectors 314 to 316 are connected to the female connectors 253 to 255.

A cutout is provided at the cover body 301 along the axial center line direction C, and is configured such that the cables 311 to 313 can be drawn. A claw 301*a* grounded to be compressed against the roof panel R is provided on an upper end face of the cover main body 301. In addition, a female screw 303 helically fitted to the above-described male screw 244 is formed on an inner wall face of the nut 302. Further, a wave washer (elastic body) 304 for biasing the second connector 310 from the side of the cover body 301 to the side of the roof panel R is disposed at an inner face side of the cover body 301 to bias the second connector 310 to the upper side shown in FIG. 1.

The thus configured antenna device 220 is assembled as follows. As in the first embodiment, the antenna main body 230 and the fixing member 300 are assembled in advance. The subsequent assembling process is roughly divided into three steps. That is, a first step is a step of temporarily locking the first connector 250; a second step is a step of temporarily locking the second connector 310; and a third step is a step of tightening the nut 302. Now, each of these three steps will be described below.

In the first step, the base 240 is positioned at the periphery of the antenna mount hole H on the roof panel R. Next, the first connector 250 is inserted into the antenna mount hole H. At this time, the engagement claw 252*a* is bent inwardly by an edge part of the antenna mount hole H before passing through the antenna mount hole H, and then, passes through the mount hole H. Then, this engagement claw returns to its original shape as illustrated, and protrudes from the antenna mount hole H. Thus, the engagement claw 252*a* engages with a back face of the roof panel R, and the first connector 250 is temporarily locked on the roof panel R.

In the second step, the male connectors 314 to 316 of the second connector 310 are inserted into the female connectors 253 to 255. Mechanical engagement and temporary lock are achieved at a time point when the male connectors 314 to 316 are inserted into the female connectors 253 to 255 to a predetermined depth. At this time, electrical conduction is also achieved.

In the third step, the female screw section 303 reaches the male screw 244 when the nut 302 is tightened, and then, the female screw section is helically fitted and tightened. Tightening of the nut 302 is stopped at a time point when the nut 302 compresses the cover body 301 against the roof panel R with a proper force. The claw 301*a* of the cover body 301 is compressed against and cut into the roof panel R, whereby grounding is provided.

As described above, according to the antenna device 220 of the present embodiment, a first temporary lock is carried out by inserting the first connector 250 into the antenna mount hole H (step 1); a second temporary lock is carried out by inserting the second connector 310 into the first connector 250 (step S2); and lastly, fixing and grounding are provided by tightening the nut 302 (step 3). Accordingly, the antenna device 220 can be mounted on the roof panel R by a simplified work, and it becomes possible to reliably provide connection and grounding.

The present invention is not limited to the above-described embodiments. For example, while the embodiments have explained connection in three sets of male connectors and female connectors, one or two sets of male connectors and female connectors may be used for actually make connections. In addition, the number of sets for making connections between the male connectors and the female connectors is not limited to three. Further, if a connection is made for use in frequency bandwidth, such a connection is not limited to the above-described connections. Of course, various modifications can occur with departing from the spirit of the invention.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. An antenna device comprising:

an antenna main body disposed on one face side of a plate material having a mount hole provided therein; and a fixing member disposed on the other face side of the plate material, the fixing member fixing the antenna main body to the plate material, wherein the antenna main body comprises:

an antenna element;

a first connector electrically connected to the antenna element;

a first screw section provided in a tightening direction in which an axial center line thereof passes through the mount hole; and an engagement section inserted into the mount hole from the one face side, thereby making engagement with the other face side, and the fixing member comprises:

a feeder line provided to make connection with the antenna element;

a second connector connected to the feeder line and provided to make mechanical engagement with, and electrical connection to, the first connector; and a second screw section helically fitted to the first screw section, thereby tightening the antenna main body, the fixing member, and the plate material with one another.

2. An antenna device according to claim 1, wherein the fixing member comprises a grounding member made of an electrically conductive material which abuts against the plate material due to tightening of the second screw section.

3. An antenna device according to claim 2, wherein the grounding member covers the second connector from an opposite side of the plate material.

4. An antenna device according to claim 3, wherein the fixing member further comprises an elastic body provided between the second connector and the grounding member.

5. An antenna device according to claim 2, wherein the fixing member comprises a restricting section which restricts a movement quantity in the tightening direction of the grounding member of the second connector in a predetermined range.

6. An antenna device according to claim 2, wherein the grounding member comprises a slippage proof section which prevents the second screw section from slipping off at an opposite side of the plate material.

7. An antenna device according to claim 1, wherein the antenna element comprises one or a plurality of elements which correspond to a plurality of frequency band.

* * * * *